United States Patent [19]

Best et al.

[11] Patent Number: 4,550,581

[45] Date of Patent: Nov. 5, 1985

[54] BREAK-AWAY KNOB DRIVER

[75] Inventors: Walter E. Best; William R. Foshée, both of Indianapolis, Ind.

[73] Assignee: Best Lock Corporation, Indianapolis, Ind.

[21] Appl. No.: 516,549

[22] Filed: Jul. 22, 1983

Related U.S. Application Data

[63] Continuation-in-part of Ser. No. 503,769, Jun. 13, 1983, , which is a continuation-in-part of Ser. No. 270,825, Jun. 5, 1981, Pat. No. 4,394,821.

[51] Int. Cl.[4] ..... E05B 3/04

[52] U.S. Cl. ..... 70/422

[58] Field of Search ..... 70/380, 422, 381, 223; 292/169.16, 169.23, 169 R

[56] References Cited

U.S. PATENT DOCUMENTS

| | | | |
|---|---|---|---|
| 2,301,751 | 11/1942 | Schlage | 70/224 |
| 3,017,762 | 1/1962 | Kubik | 70/422 X |
| 4,195,502 | 4/1980 | Best et al. | 70/224 |
| 4,394,821 | 7/1983 | Best et al. | 70/380 X |

OTHER PUBLICATIONS

Walter E. Best et al., application Ser. No. 503,769, filed Jun. 13, 1983 (Drawings and Abstract).

*Primary Examiner*—Richard E. Moore

*Attorney, Agent, or Firm*—Barnes & Thornburg

[57] ABSTRACT

A keyed lever handle for a cylindrical lock is rotatably mounted by its neck on the knob sleeve of the lock and is connected to rotate the sleeve by a driver having a drive lug which breaks away under a predetermined high torque so as to protect the lock mechanism from excess torque. The driver is mounted in two opposite slots in the sleeve and the drive lug projects radially through one of such slots into positive engagement with an inward-opening recess in the knob. The lug is preferably formed with an end recess which leaves two upstanding ears at the sides of the lug which are adapted to shear in the shear plane between the knob and sleeve under excess torque. The driver is preferably trapped in place in the sleeve by the knob, but for assembly and service purposes is also held by a resilient rubber ball or the like received in an opening in the driver and resiliently engaged with the edge of the opposite slot in the knob sleeve.

20 Claims, 6 Drawing Figures

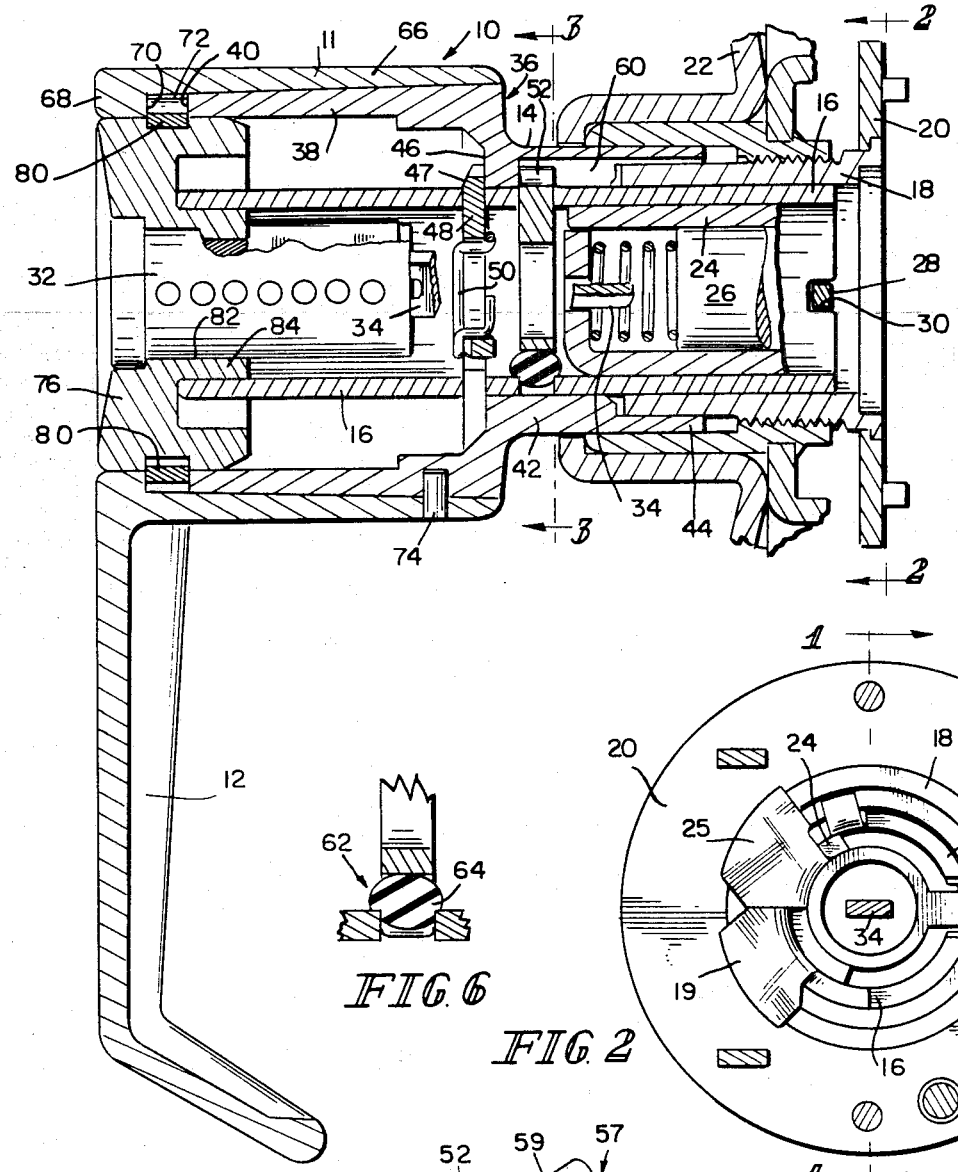
FIG. 1
FIG. 6
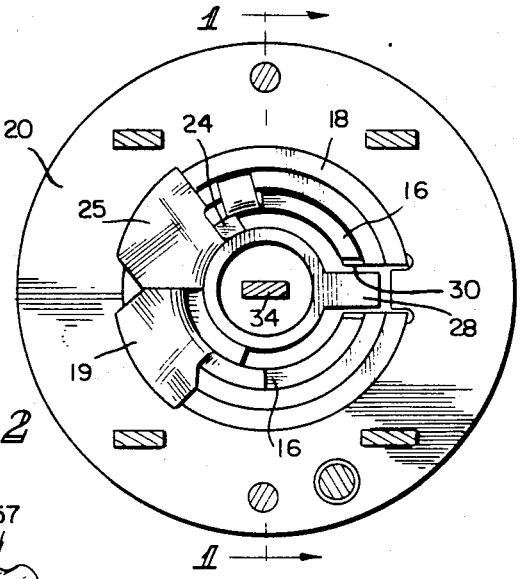
FIG. 2
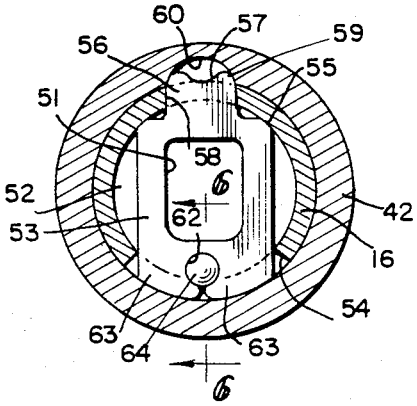
FIG. 3
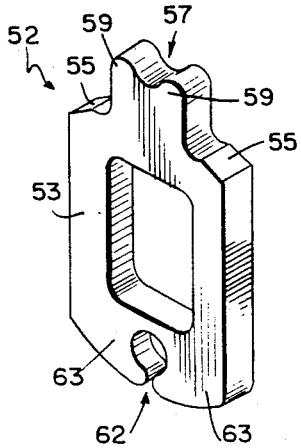
FIG. 4
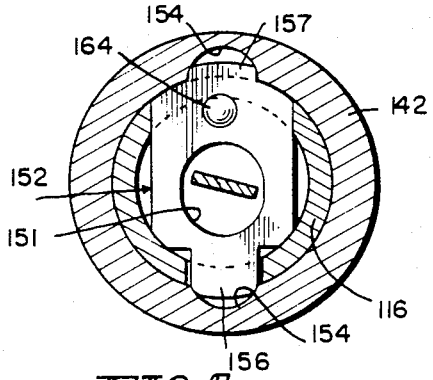
FIG. 5

BREAK-AWAY KNOB DRIVER

This application is a continuation-in-part of our co-pending application U.S. Ser. No. 503,769, filed June 13, 1983, which was a continuation-in-part of our co-pending application U.S. Ser. No. 06/270,825, filed June 5, 1981, designated to issue as U.S. Pat. No. 4,394,821 on July 26, 1983.

This invention relates to door lock mechanisms, and particularly to a driver for connecting a doorknob or the like to a bolt-retracting knob sleeve and adapted to shear under conditions of excessive torque to prevent the transmission to the lock mechanism of excessive torque applied to the doorknob. As used herein, the term "knob" is intended to include a lever handle.

Door locks are subject to attack by the exertion of high torque on the doorknob sufficient to damage or override the lock mechanism and thus to jeopardize the security of the lock. Lever handle knobs are particularly susceptible to the application of such excessive torque, since a strong person may be able to manually twist the lever handle with sufficient force to apply such high torque, and lever handles are also liable to attack by the application of force with the use of a tool applied to the projecting lever of the handle. Nevertheless, lever handle knobs are desirable and in some cases mandatory to facilitate operation of door locks by handicapped or other persons who are not able to grip and turn a round knob.

Door lock mechanisms may include a positive driver of the type shown in our co-pending application Ser. No. 06/270,825, filed June 5, 1981, to provide a positive drive between the door knob and the knob sleeve. Application of excessive torque to the lever handle of such a mechanism can rotate the knob sleeve through the driver to break or override the locking lug which normally limits lock operation to use of a proper key, and thus open a locked door.

Alternatively, door lock mechanisms may include a torque-releasable driver of the type shown in our co-pending application U.S. Serial No. 503,769, filed June 13, 1983, and more fully shown in our co-pending application Ser. No. 06/270,825. The torque-releasable driver is biased to its engaged position to connect the doorknob to rotate the knob sleeve under normal operating torque, but releases under excessive torque to permit the knob to rotate with respect to the knob sleeve, and thus to prevent damage and improper operation of the lock mechanism. Following such interruption of the drive connection, the knob can be rotated to a position where normal drive connection is re-established, as is more fully explained in our co-pending application Ser. No. 503,769.

With a round knob there is a relatively wide margin between the torque which can be applied manually to the knob and the torque necessary to damage the lock mechanism, and torque-releasable drivers can effectively transmit manual torque with little likelihood of release under normal operating conditions. With a lever handle, on the other hand, there is a relatively narrow margin between the torque which can be applied manually in ordinary use and the torque that will damage the lock. Accordingly, it is desirable with lever handles to control much more closely the torque at which the handle will be released from its driving connection to the knob sleeve. The present invention provides such close control, by utilizing a break-away driver which will transmit a high torque for normal operation but will break away under a predetermined higher torque below what is likely to damage or override the lock mechanism. The invention further provides simple means for retaining the driver in place during assembly and which permits easy replacement of a driver which has been broken by excess force.

In accordance with the invention, a lever handle or other desired knob is rotatably mounted on a knob sleeve or the like and is connected to transmit torque to the sleeve by a driver mounted transversely in the knob sleeve and having a drive lug extending into engagement with a recess, preferably an axial groove, in the knob. The lug is made of a material and in such shape that it will shear or break away under a predetermined drive torque applied to the handle. Preferably, the driver is in the form of a generally rectangular body which fits slidably in a slot at one side of the knob sleeve and the lug is a narrower projection on such body which fits slidably through a narrower slot in the opposite side of the sleeve. The lug thus extends through the wall of the knob sleeve and across the shear plane between the cylindrical surfaces of the knob sleeve and knob, and into the recess or groove in the knob. Torque transmitted from the knob to the sleeve exerts shear stress at such plane, and the lug is made so as to break away at such shear plane and release the drive connection between the knob and sleeve.

The driver may have a central opening to provide clearance for a throw member connecting a key-operated key plug to the roll-back cam which it operates. The driver is desirably trapped in the knob sleeve when a knob is in place on such sleeve, but is also desirably held in place by other means for purposes of manufacturing assembly and to prevent inadvertent loss during field service.

In further accordance with the present invention, the driver is held in place by a resilient member, preferably a ball of rubber or other resilient material mounted in a hole in the driver which lies across the inner surface of the knob sleeve. The ball is larger than the thickness of the driver so that it projects from one or both sides of the driver into resilient engagement with the inner edge of the slot of the sleeve in which the wide body of the driver is mounted. The driver is desirably held against movement in the direction of the lug by shoulders on the driver body which engage the opposite wall of the knob sleeve.

The accompanying drawings illustrate the invention and show embodiments exemplifying the best mode of carrying out the invention as presently perceived. In the drawings:

FIG. 1 is a horizontal axial section of a cylindrical lock mechanism in accordance with the invention and having a lever handle as its knob;

FIG. 2 is a transverse section on the line 2—2 of FIG. 1;

FIG. 3 is a section taken on the line 3—3 of FIG. 1 showing a break-away driver which is positively held against retraction and includes a break-away drive lug, the driver being removably secured in the knob sleeve by a resilient ball;

FIG. 4 is an isometric view of the break-away driver as shown in FIGS. 1 and 3;

FIG. 5 is a sectional view similar to FIG. 3 but showing a positive driver releasably held in the knob sleeve by a resilient ball; and FIG. 6 is a section taken on the line 6—6 of FIG. 3 showing the resilient ball holding the driver in the knob sleeve.

The lock mechanism shown in FIGS. 1, 2, and 3 comprises a door handle 10 having an outer hand-hold portion 11 which carries a handle lever 12 and has a neck portion 14 by which it is mounted on a generally cylindrical knob sleeve 16. The sleeve is mounted for rotation in a hub 18 fixed to a chassis side plate 20 of a cylindrical lock mechanism, as more fully shown in U.S. Pat. No. 3,955,387. The inner end of the knob sleeve 16 carries a roll-back cam 19 (110 in such patent) adapted to engage a retractor for retracting the bolt of the door. A trim ring assembly 22 is threaded on the outside of the hub 18 and extends outward into overlapping relation with the neck portion 14. A key-actuated roll-back cam sleeve 24 is rotatably mounted within the knob sleeve 16 and carries at its inner end a second roll-back cam 25 (114 in the patent). For convenience of illustration, the roll-back cams 19, 25 are shown only in FIG. 2 and are not shown in FIG. 1. Also, in this and other aspects, the showing in FIG. 1 may be considered somewhat diagrammatic in that certain parts are shown in a rotational orientation different from what they may take in the actual lock mechanism.

For purposes of locking the knob sleeve 16 against rotation and thus to limit lock actuation to that provided by key actuation of the cam sleeve 24, a locking lug bushing 26 (122 in the patent) is slidably mounted within the roll-back cam sleeve 24. This carries at its inner end a locking lug 28 which in its normal position extends radially from the bushing 26 outward across the end face of the knob sleeve 16 and into a notch in the hub, as more fully shown in said patent. The bushing 26 is adapted to be moved outward against its biasing spring, as by a thumbpiece on the associated inside knob, to carry the locking lug 28 into a notch 30 in the end of the knob sleeve 16 so as to lock such knob sleeve 16 against rotation relative to the hub 18. When the knob sleeve is thus locked against rotation, the lock mechanism may be operated by a key-operated core 32 mounted in the handle 10 as more fully explained below. The core 32 is connected by a throw member 34 to the key-actuated cam sleeve 24.

As shown, the handle 10 comprises a hollow body 36 which at its inner end forms the neck 14 of the handle and which has an outward-extending body shell portion 38, conveniently of cylindrical shape and having at its outer end a flat end face 40. The inner face of the body shell is desirably cylindrical and defines a circular end opening.

The neck portion 14 of the hollow body 36 includes a relatively thick cylindrical portion 42 in rotative bearing engagement with the outer surface of the sleeve 16. Inward beyond such thick portion 42, the neck has a thinner portion 44 which is telescopically received between the trim ring assembly 22 and the outer end of the hub 18.

For purposes of retaining the handle 10 on the knob sleeve 16, the knob body 36 is formed with a circumferentially continuous radial face 46 at the outer end of the thick portion 42. Such face is engaged by a projecting lug 47 on a retainer 48 mounted for radial movement in cross slots in the knob sleeve 16, and biased to engaged position by a biasing spring 50, as more fully shown in co-pending application Ser. No. 06/270,825.

The outward cylindrical shell portion 38 of the handle body 36 is telescopically received within a cylindrical shell 66 which extends from the rear of such body shell 38 forward past the end face 40. At its forward end, such outer shell 66 is formed with an inward-extending flange 68 desirably having an inner cylindrical surface aligned with the inner cylindrical surface of the body shell 38. Such flange 68 has an inward end face 70 in spaced relation to the end face 40 of the body shell 38, so as to define therebetween a radially inward-opening circumferential groove 72.

The handle lever 12 is integral with the outer shell 66, and such shell 66 is fixed to the body 36 by a press-in pin 74, which is finished off flush with the surface of the shell 66, desirably located in the same plane with the handle lever 12.

An end face closure member 76 is rotatably mounted in the end opening defined by the inner faces of the flange 68 and the body shell 38, and is rotatably locked in place by a buried ring 80 which has a portion engaged in the groove 72. The face closure member 76 is formed with a figure-8 opening 82 for the reception of the key-operated core 32 containing a key plug coaxial with the handle body 36 and knob sleeve 16 and connected to the throw member 34 so that key operation of the key plug will rotate the throw member 34 to actuate the cam member 24 for retracting the latch bolt of the lock mechanism.

Desirably, the face closure member 76 is formed with a rearward-extending circular flange 84 which is non-rotatably interlocked with the forward end of the knob sleeve 16.

This rotative mounting of the face closure member 76 interacts with the break-away drive connection between the handle and knob sleeve 16, in that it permits the handle to rotate relative to the face closure member and hence relative to the core 32 and knob sleeve 16 when excessive torque breaks the break-away drive connection between the handle and the knob sleeve.

In the embodiment of FIGS. 1 and 3, a drive connection between the handle 12 and the knob sleeve 16 is formed by a break-away driver 52. The driver 52 has a generally rectangular body portion 53 which is slidable through and engaged in a relatively wide slot 54 at the bottom of the knob sleeve 16. At its opposite end, the driver 52 carries a driving lug 56 which extends through an opposite narrower slot 58 in the knob sleeve. The drive lug 56 includes a proximal portion integrally fixed to one end of the body portion 53 and a distal portion which engages in an axial groove 60 in the heavy wall 42 of the handle body 14 to provide a drive connection between the handle and the knob sleeve. The central body has side shoulders 55 adjacent the lug 56 which engage against the inner face of the knob sleeve 16 at opposite sides of the slot 58, and has a central opening 51 to clear the throw member 34.

To prevent excessive torque from being transmitted between the lever handle 10 and the knob sleeve 16, the drive lug 56 is weakened so as to break away or shear at the shear plane between the handle portion 42 and the knob sleeve 16 when excessive torque is applied to the lever handle, and then to allow that handle to rotate about the knob sleeve.

In the arrangement shown, the lug 56 is weakened by forming it with an end recess 57 which leaves two upstanding ears 59 at its sides which are designed to transmit full normal operating torque but break away when a predetermined torque is applied to the handle. To this end, the driver 52 is made of such material and the ears 59 have such a cross section that under such predetermined high torque the lug 56 will break away in the shear plane between the handle body portion 42 and the knob sleeve 16 and will thus prevent the excess torque from being transmitted to the lock mechanism.

The driver 52 extends diametrically across the knob sleeve 16 from the lug 56 and has its opposite or butt end in abutting relationship with the surrounding body portion 42 of the knob so that it is trapped in place when the parts are in assembled operating condition. For purposes of retaining the driver 52 in place in the knob sleeve 16 when no handle body 36 is present, the driver 52 is formed with an opening 62 which intersects the inside surface of the knob sleeve 16, and a rubber ball 64 or other elastic element is press-fitted in such opening. The ball-receiving opening 62 is essentially a round hole, but to avoid a thin section between it and the butt end of the driver, the opening is extended through such butt end to leave a pair of opposed jaws 63. The ball resiliently engages the side edges of the slot 54 in the wall of the driver, as indicated in FIG. 6, so as to retain the driver 52 in place. In the event the driver lug 56 is broken away, the driver 52 is readily removed and replaced by first removing the knob to expose the broken driver, then pressing such driver out of the knob sleeve, and then inserting a new driver 52 and ball 62 through the slot 54.

EXAMPLE

A torque-releasable driver in accordance with the present invention was manufactured from powdered nickel steel to produce a sintered low-density powdered metal part. A material in compliance with the Metal Powder Industries Federation (MPIF) specification FN-0208-R was used. An alternative nickel steel material is MPIF-FN-0405-R.

FN-0208-R is characterized by a dry-density range of 6.4 to 7.2 g/cc. FN-0208-R is obtainable from GKN POWDER MET, INC., with offices in Worcester, MA. The GKN number for FN-0208-R is SN-208. FN-0405-R is available from the same source as SN-405.

Manufactured drivers of different densities were tested to determine the actual break points of the upstanding ears. It was found that for a driver 52 as shown, a density within the range 6.4 $\pm$0.2 g/cc would shear in response to an applied torque of 300+25–50 inch-pounds, and it was determined that this would meet the requirements of the present invention. A consistant density could be held in the manufacture of the lug 56, and particularly in the manufacture of the two ears 59 to assure that the torque-releasable driver would shear under the desired torque with the lever handle here shown and the locking lug 28 of a standard construction. The break-away torque of 64 $\pm$0.2 g/cc was determined to be desirable and effective, both to give reliable operation and to protect the lock mechanism from excessive torque.

An alternative driver of similar shape was manufactured using 0.120 inch half-hard cold-rolled steel material. This also gives effective results.

The use of a resilient ball 64 in an opening 62 for releasably retaining a driver or the like in a knob sleeve or other tubular member is useful and advantageous in other applications beside that shown in FIGS. 1, 3, and 6. One such other application is shown in FIG. 5. Here, a positive driver 152 is mounted in a tubular knob sleeve 116 in a manner analogous to that in FIGS. 1 and 3, and has drive lugs 156 and 157 at opposite ends, engaged in grooves 154 at diametrically opposite points in the neck 142 of a knob, so as to give a positive drive connection between the knob and knob sleeve. The knob may be of any desired configuration, including a lever handle knob as here shown or a knob of a conventional round or other shape. The positive driver is trapped in the knob sleeve when the parts are assembled, but needs to be held in the knob sleeve when the knob neck 142 is absent, as for purposes of assembly and to prevent its loss during field service. To this end, the driver 152 is formed with a round hole 162 which intersects the inner surface of the knob sleeve 116, and a resilient ball 164 is pressed into such hole. When the driver, with the ball in place, is inserted through its mounting slots in the knob sleeve, the ball is carried to the position shown, where it resiliently engages the transverse inner edges of the adjacent mounting slot to releasably hold the driver in place. The resilient ball serves the same purpose as the metal spring 62 shown in FIG. 2 of application Ser. No. 06/503,769, but is less expensive and less complex.

Assembly of the embodiment of FIGS. 1–4 may be as follows: A driver 52 with a ball 64 in place in its opening 62 is inserted through the wide slot 54 in the knob sleeve 16, to carry its drive lug 56 through the narrower slot 58 and bring the shoulders 55 against the inside surface of the knob sleeve, as shown in FIG. 3. This carries the ball 64 partway through the wide slot 54 to the position shown in FIG. 6, where the ball engages the transverse inside edges of that slot and holds the driver in place. A knob assembly 10 is then slid axially over the knob sleeve in an orientation which permits the drive lug 56 to enter the groove 60. As the knob moves toward its final position, it engages the cam surface of the knob retainer lug 47 so as to retract the retainer until the knob face 46 passes the retainer. The retainer then moves to its retaining position as shown in FIG. 1.

In operation, the break-away driver 52 gives a positive connection to tansmit torque from the lever handle 10 to the knob sleeve 16 to rotate the sleeve to retract the latch bolt of the lock, under all normal conditions of operation. When the knob sleeve is locked against rotation by the lug 28, such lug will hold the knob sleeve and knob against rotation under torque which would normally be applied to the lever handle 10. In the event an attempt is made to force the lock by applying high torque to the handle, the break-away lug of the driver will shear under a torque less than what would damage or override the locking lug 28. This will release the drive connection from the lever handle 10 to the knob sleeve 16 and the handle will become inoperative to operate the lock. The key-operating mechanism will remain intact so that the lock will be operable by a proper key. The broken driver 52 can be readily replaced. The core 32 is first removed by use of a special key, and this permits insertion of a tool to retract the knob retainer 48. The handle 10 is then removed to expose the broken driver. Such driver is driven out of the knob sleeve and replaced with an intact driver, and the handle is then reinstalled on the knob sleeve.

Although the invention has been described in detail with reference to certain preferred embodiments and specific examples, variations and modifications exist within the scope and spirit of the invention as defined in the following claims.

What is claimed is:

1. In a door lock mechanism having a cylindrical knob sleeve or the like on which a knob or handle is rotatably mounted, a retainer for retaining the knob or handle on the knob sleeve, the knob sleeve having an inner face, means for connecting the knob against rotation on the knob sleeve comprising a separate driver mounted transversely in the knob sleeve in a spaced-relation to the retainer, and a drive lug on the driver, the drive lug projecting radially from the knob sleeve into positive engagement with an inward-opening recess in the knob, the drive lug being formed with a weak section adapted to shear under a predetermined torque to release the torque-transmitting connection between the knob and knob sleeve.

2. The door lock mechanism of claim 1 wherein the driver includes a generally rectangular body portion, and the drive lug includes a proximal portion integrally fixed to one end of the body portion and a distal portion carrying said weak section.

3. The door lock mechanism of claim 2 wherein the driver is substantially flat and includes a pair of shoulders at opposite sides of the lug to engage the inner face at one side of the knob sleeve for positioning the driver in the knob sleeve, an opening in the driver intersecting the inner face at the opposite side of the knob sleeve, and a resilient retainer in said opening and projecting into engagement with the wall of the knob sleeve to retain the driver in place in the knob sleeve.

4. The door lock mechanism of claim 2 wherein the distal portion of the drive lug includes a plurality of break-away ears, said ears being of such cross section and material that the ears will shear in the shear plane between the knob and the knob sleeve under a predetermined torque so as to break away from the drive lug and permit the knob to rotate on the knob sleeve.

5. The door lock mechanism of claim 4 wherein the driver is formed of sintered low-density powdered metal.

6. The door lock mechanism of claim 4 wherein the driver is formed of steel sheet stock.

7. The door lock mechanism of claim 3 wherein the resilient retainer is a resilient ball of rubber or the like received in said opening to resiliently engage the knob sleeve to retain the driver in the knob sleeve.

8. The door lock mechanism of claim 1 wherein the driver comprises a generally flat, rectangular body portion slidably received in a relatively wide slot at one side of the knob, said lug being narrower than said body portion and extending slidably through a relatively narrower slot at the opposite side of the knob sleeve, said body portion forming a shoulder at the side of the lug which engages the inner face of the knob sleeve adjacent the narrower slot to position the driver in the knob sleeve, the body portion having an opposite end face adapted to abut a surrounding knob portion so that the driver is trapped in place when the knob is mounted on the knob sleeve.

9. The lock mechanism as in claim 8 with the addition of means acting between the driver and knob sleeve for releasably retaining the driver in place in the absence of a surrounding knob portion.

10. The lock mechanism as in claim 9 in which said driver retaining means comprises a resilient ball press-fitted in an opening in the driver and projecting therefrom into engagement with the inner edge of said relatively wide slot.

11. Lock mechanism comprising knob sleeve or the like and a knob or the like rotatably mounted on the sleeve, a retainer for retaining the knob on the knob sleeve, a transverse opening in the sleeve to receive a separate driver in spaced-relation to the retainer, and an inward-opening recess in the knob to receive a drive lug on the driver for transmitting torque from the knob to the sleeve, a break-away driver having a body portion mounted on the transverse opening in the sleeve and having a drive lug extending through a close-fitting opening of the sleeve and into the recess of the knob to establish a torque-transmitting connection between the knob and sleeve, said lug being adapted to break away under a predetermined torque so as to release said torque-transmitting connection.

12. Lock mechanism as in claim 11 in which said lug is formed of low-density powdered metal.

13. Lock mechanism as in claim 11 in which said lug is formed with a weak section adapted to shear at the shear plane between the knob and sleeve.

14. Lock mechanism as in claim 12 in which said lug is formed with a weak section adapted to shear at the shear plane between the knob and sleeve.

15. Lock mechanism as in claim 11 in which said lug is formed with an end recess and ears at the sides of the lug extending across the shear plane between the knob and sleeve and adapted to shear in such plane at said predetermined torque.

16. Lock mechanism as in claim 12 in which said lug is formed with an end recess and ears at the sides of the lug extending across the shear plane between the knob and sleeve and adapted to shear in such plane at said predetermined torque.

17. Lock mechanism as in claim 16 in which the end recess of the lug is in the form of an arcuate concavity.

18. Lock mechanism comprising a knob sleeve or the like and a knob or the like rotatably mounted on the sleeve, a transverse opening in the sleeve to receive a driver, and an inward-opening recess in the knob to receive a drive lug on the driver for transmitting torque from the knob to the sleeve, a driver having a body portion slidably received in one end of said transverse opening and having a shoulder to engage an inner surface of the sleeve to position the driver in the sleeve, said driver having a lug projecting therefrom to engage in the knob recess to establish a torque-transmitting connection between the knob and sleeve, and means to retain the driver in the recess comprising a resilient ball-like member mounted in a transverse hole in the driver and projecting therefrom into retaining engagement with the sleeve.

19. Lock mechanism comprising a tubular sleeve having transverse slots in its opposite walls, a member mounted in said slots, said member being slidably inserted through one of said slots and extending into the opposite slot and having means to stop the member at a predetermined position in the sleeve, and means to retain said member in said position comprising a resilient ball-like member press-fitted in a transverse oepning in said member and protruding therefrom into engagement with an edge of said one slot.

20. In a door lock mechanism having a cylindrical knob sleeve or the like on which a knob or handle is rotatably mounted, the knob sleeve having an inner face, means for connecting the knob sleeve and the knob for torque transmission therebetween comprising a driver mounted transversely in the knob sleeve and having a ball-receiving opening in close proximity to the inner face of the knob sleeve, and a drive lug protruding from the driver to positively engage an inward-opening recess in the knob or the like, and a rubber ball received in the ball-receiving opening to resiliently engage the knob sleeve so that the driver is retained within the knob sleeve for rotation therewith.

* * * * *